US005992077A

United States Patent [19]

Dubois

[11] Patent Number: 5,992,077

[45] Date of Patent: Nov. 30, 1999

[54] NOSE CONE AND METHOD FOR ACOUSTICALLY SHIELDING AN UNDERWATER VEHICLE SONAR ARRAY

[75] Inventor: Neil J. Dubois, Cranston, R.I.

[73] Assignee: The United States of America as represented by the Secretary of the Navy, Washington, D.C.

[21] Appl. No.: 09/045,962

[22] Filed: Mar. 18, 1998

[51] Int. Cl.[6] ..... C06D 45/00

[52] U.S. Cl. ..... 42/293; 114/20.1; 367/162

[58] Field of Search ..... 367/162, 153; 102/293, 399; 114/20.1, 21.3

[56] References Cited

U.S. PATENT DOCUMENTS

| | | | |
|---|---|---|---|
| 3,833,880 | 9/1974 | Abbott | 340/8 R |
| 4,093,935 | 6/1978 | Ouellette | 340/8 S |
| 4,341,173 | 7/1982 | Hagelberg et al. | 114/20 A |
| 4,665,750 | 5/1987 | Rogers | 73/587 |
| 4,731,763 | 3/1988 | Wagner | 367/153 |
| 4,974,213 | 11/1990 | Siwecki | 367/88 |
| 5,323,708 | 6/1994 | Sigler | 102/520 |
| 5,428,582 | 6/1995 | Madden et al. | 367/162 |
| 5,786,544 | 7/1998 | Gill et al. | 102/293 |

*Primary Examiner*—Charles T. Jordan
*Assistant Examiner*—Denise J Buckley
*Attorney, Agent, or Firm*—Michael J. McGowan; James M. Kasischke; Prithvi C. Lall

[57] ABSTRACT

A nose cone for attachment to an underwater vehicle for shielding a sonar array in a nose portion of the vehicle from acoustic pressures in a water environment, the nose cone comprising a tubular body for surrounding side wall portions of the vehicle nose portion, a cap fixed to one end of the nose cone body for overlying a forward-most portion of the vehicle nose portion, and bleed tubes extending through the body and/or cap for permitting air to escape from between the vehicle nose portion and the nose cone when the nose cone is placed on the vehicle nose portion. There is further contemplated a method for acoustically shielding sonar arrays in nose portions of underwater vehicles, which includes utilization of the aforementioned nose cone.

9 Claims, 2 Drawing Sheets

NOSE CONE AND METHOD FOR ACOUSTICALLY SHIELDING AN UNDERWATER VEHICLE SONAR ARRAY

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to underwater vehicles having sonar arrays therein, and is directed more particularly to a nose cone for attachment to a test vehicle to shield the sonar array from acoustic pressure so that noise resulting solely from structural vibration of the vehicle can be determined.

(2) Description of the Prior Art

It is known to provide underwater vehicles, such as torpedoes, with sonar arrays adapted to receive noise from a water environment and to lock in on a portion of such noise for possible target acquisition. However, the noise received by the array is a combination of acoustic pressures in the water and noise generated by vehicle structural vibration reaching the array through the array support structure. There is a need for means by which the structural noise can be isolated and measured.

SUMMARY OF THE INVENTION

Accordingly, an object of the invention is to provide means by which acoustic pressure generated noise is shielded from the sonar array, permitting only noise generated through structural vibration of the vehicle to reach the sonar array, so as to facilitate measurement of the structural generated noise.

A further object of the invention is to provide a method for shielding a sonar array in a nose portion of an underwater test vehicle from acoustic pressure in a water environment, to isolate and measure the structural generated noise input to the array.

With the above and other objects in view, as will hereinafter appear, a feature of the invention is the provision of a nose cone for attachment to an underwater vehicle for shielding a sonar array in a nose portion of the vehicle from acoustic pressures in a water environment, the nose cone comprising a substantially cylindrically-shaped tubular body for surrounding side wall portions of the vehicle nose portion, a cap fixed to one end of the nose cone body for overlying a forward-most portion of the vehicle nose portion, and bleed tubes extending through the nose cone body and/or cap for permitting air to escape from between the vehicle nose portion and the nose cone when the nose cone is placed on the vehicle nose portion.

In accordance with a further feature of the invention, there is provided a method for shielding a sonar array in a nose portion of an underwater vehicle from acoustic pressures in a water environment, the method comprising the steps of providing a nose cone including a substantially cylindrical tubular body, a cap fixed to one end of the body, bleed tubes extending through the body or cap, and bleed tube caps for closing off the bleed tubes, sliding the nose cone body onto side wall portions of the vehicle nose portion with the bleed tube caps removed from the bleed tubes, until the nose cone cap is proximate a forward-most portion of the vehicle nose portion, and closing the bleed tubes with the bleed tube caps, whereby to ready the vehicle for underwater operation with the sonar array shielded by the nose cone.

The above and other features of the invention, including various novel details of construction and combinations of parts and method steps, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent. In the drawings.

DESCRIPTION OF THE PREFERRED EMBODIMENTS

Figure 1:
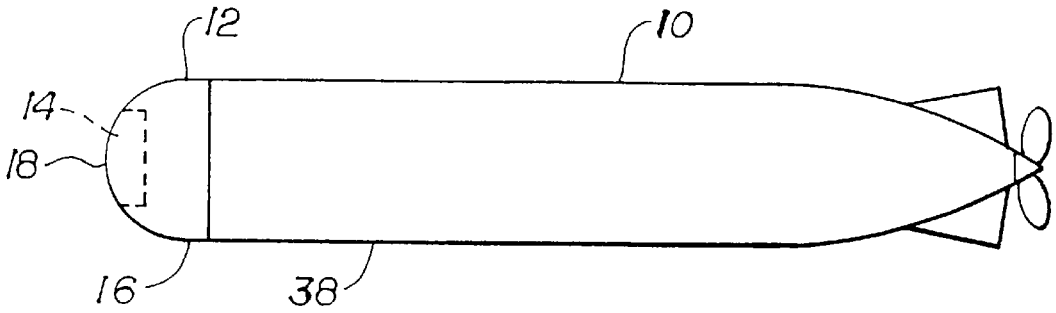
FIG. 1 (Prior Art)
FIG. 1 is a diagrammatic side elevational view of a prior art underwater vehicle having a sonar array in a nose portion of the vehicle.

In FIG. 1, there is shown a known combination of underwater vehicle 10, such as a torpedo, or the like, and, in a nose portion 12 thereof, a sonar array 14. The vehicle nose portion 12 includes a side wall portion 16 and a forward-most portion 18.

The sonar array 14 receives acoustic pressure signals generated by objects, such as ships and submarines, in the water environment of vehicle 10, along with general background underwater noise. Using a portion of the acoustic pressure signals, vehicle 10, by a target acquisition and guidance means (not shown) "homes in" on the target. As noted above, sonar array 14 also receives noise generated by vibrations in the vehicle itself, diluting the target generated signals and reducing the accuracy with which such target-generated signals are interpreted and used to guide the vehicle.

Figure 2:
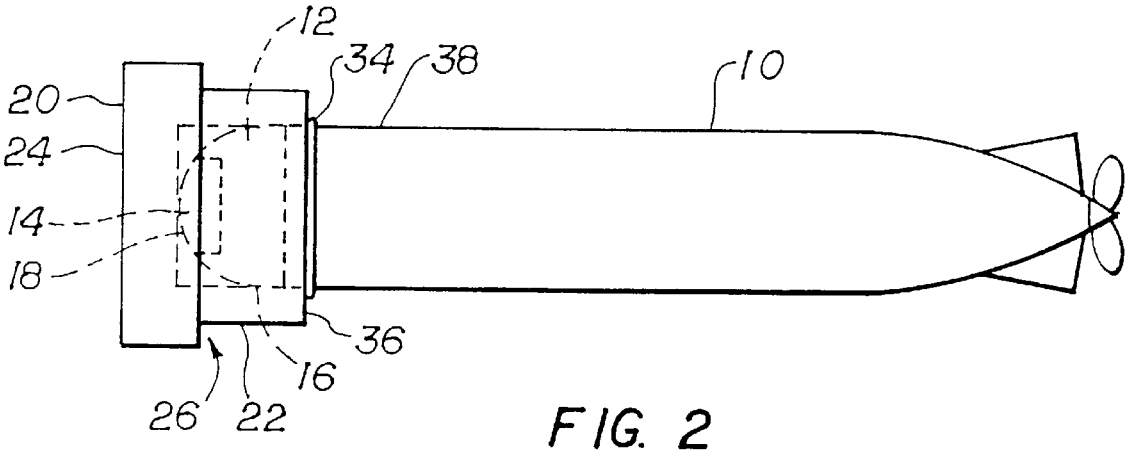
FIG. 2 is a diagrammatic side elevational view of one form of nose cone illustrative of an embodiment of the invention, in combination with the prior art vehicle of FIG. 1.

To segregate the vehicle-generated noise and facilitate discounting of such noise in target acquisition situations, in FIG. 2 there is provided a nose cone 20 for attachment to test vehicle 10 for shielding sonar array 14 in nose portion 12 of vehicle 10 from acoustic pressure in the water environment. The nose cone 20 includes a substantially cylindrically-shaped tubular body 22 for surrounding side wall portions 16 of nose cone body 22, and a nose cone cap 24, the sizes of which are at least in part dictated by the size of the vehicle 10. The cap 24 is fixed to one end 26 of body 22 for overlying the forward-most portion 18 of vehicle nose portion 12.

Figure 3:
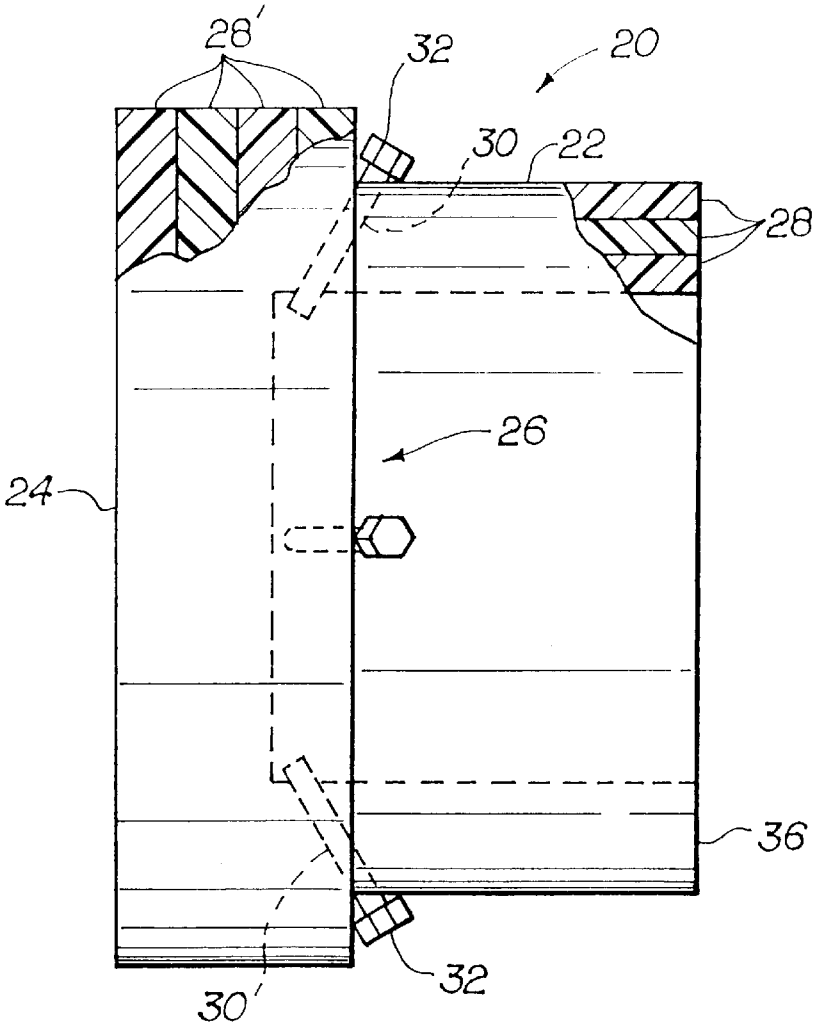
FIG. 3 is an enlarged side elevational view, partly broken away and in section, of the nose cone of FIG. 2.

Referring now to FIG. 3, sheets 28, 28' of material form body 22 and cap 24 and are adhesively bonded, such that sheets 28 in body 22 are adhesively bonded together, and sheets 28' in cap 24 are adhesively bonded together. Further, in the preferred embodiment, nose cone cap 24 is adhesively bonded to the nose cone body 22. The number of sheets, or layers, of foam is selected according to the desired thickness.

The elastomeric foam selected must be of the closed-cell type and must be amendable to adhesive bonding. In addition, the foam selected must be sufficiently rigid and of sufficient strength such that the closed cells therein do not collapse under water pressure at a selected depth of the vehicle in the water environment.

There is thus provided a simple, low-cost means for isolating acoustic pressures from a sonar array in an underwater test to facilitate determination of structure-borne excitation of the array. The nose cone is of light weight, is easily installed and is readily removable, which is facilitated in large measure by the bleed tubes. The layered construction allows for a range of isolation obtained, based upon the needs of a specific vehicle nose portion 12.

Figure 4:
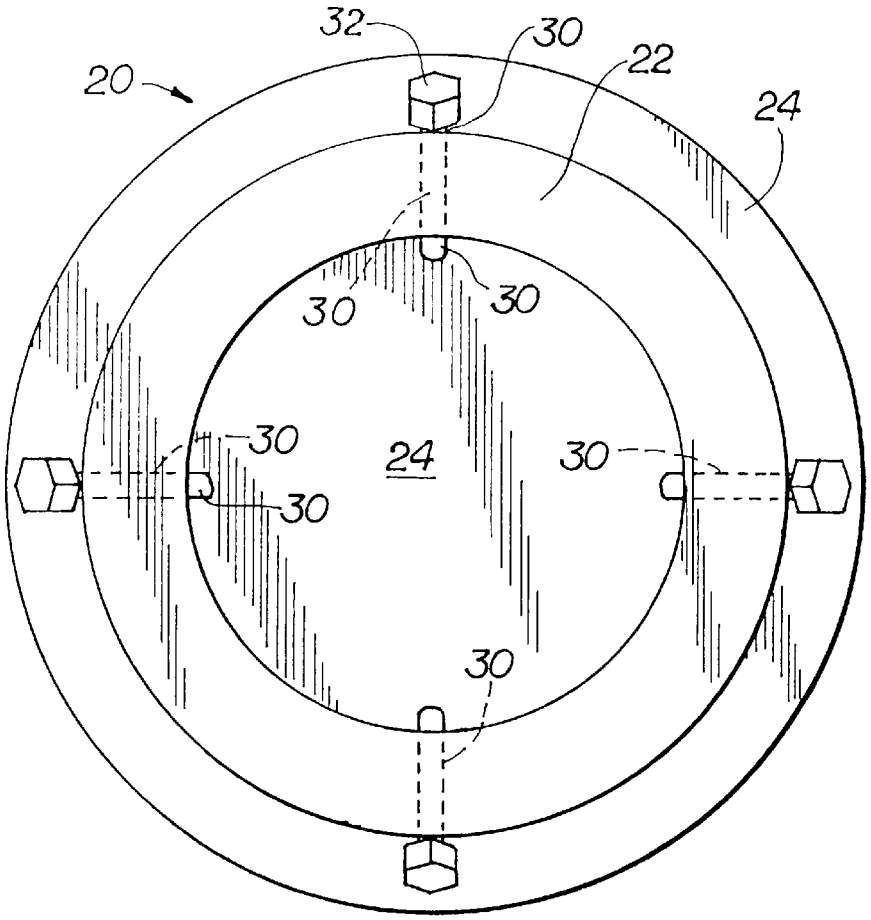
FIG. 4 is a stern view of the nose cone of FIGS. 2 and 3.

Bleed tubes 30 (FIGS. 3 and 4) extend through nose cone body 22 and/or cap 24 for permitting air to escape from between the vehicle nose portion 12 and nose cone 20 when nose cone 20 is placed on vehicle nose portion 12. The bleed tubes 30 further permit air to enter between vehicle nose portion 12 and nose cone 20 when nose cone 20 is removed from vehicle nose portion 12, as will be further described hereinbelow.

The nose cone 20 further includes bleed tube caps 32 for fixing to bleed tubes 30 to close bleed tubes 30 and prevent entry of water through bleed tubes 30 when the vehicle, with nose cone 20 mounted thereon, is submerged, as will be further described hereinbelow.

In carrying out the inventive method for shielding a sonar array in a nose portion of an underwater vehicle from acoustic pressures in a water environment, there is first provided the nose cone 20 substantially as described hereinabove. The nose cone body 22 is slid onto side wall portion 16 of vehicle nose portion 12, with bleed tube caps 32 removed from bleed tubes 30, until nose cone cap 24 is proximate forward-most portion 18 of vehicle nose portion 12. The open bleed tubes 30 permit air to escape from between nose cone 20 and vehicle nose portion 12. The bleed tube caps 32 are then fixed on bleed tubes 30 to close off the bleed tubes. The vehicle is then ready for underwater operation. In the course of such operation, bleed tube caps 32 prevent entry of water through bleed tubes 30, and nose cone 20 shields sonar array 14 from acoustic pressures originated outside the vehicle 10. Measurements are taken of the internally generated noise received by sonar array 14 and the parameters of such noises are recorded and stored for subsequent use.

Depending upon the tolerance between the nose cone 20 and vehicle nose side wall portion 16, a bead of sealant 34 (FIG. 2) may be provided along a juncture of an after end 36 of the nose cone body 22 and a vehicle side wall portion 38.

After removal of the vehicle from the water, caps 32 are removed from bleed tubes 30, sealant bead 34 is stripped away, and nose cone 20 is slid off nose portion 12 of vehicle 10. The open bleed tubes 30 allow air to enter the space between vehicle 10 and nose cone 20, to relieve any vacuum created therein. There is thus provided a method for easily and relatively inexpensively obtaining a measurement of vehicle-generated noise reaching the sonar array. It is to be understood that the present invention is by no means limited to the particular construction and method herein disclosed and/or shown in the drawings, but also comprises any modifications or equivalents within the scope of the claims.

What is claimed is:

1. A nose cone for attachment to an underwater vehicle for shielding a sonar array in a nose portion of the vehicle from acoustic pressures in a water environment, said nose cone comprising:

a substantially cylindrically-shaped tubular body for surrounding side wall portions of said vehicle nose portion;

a cap fixed to one end of said body for overlying a forward-most portion of said vehicle nose portion; and bleed tubes extending through a selected one of said body, said cap, and said body and said cap for permitting air to escape from between said vehicle nose portion and said nose cone when said nose cone is placed on said vehicle nose portion.

2. The nose cone in accordance with claim 1 and further comprising bleed tube caps for fixing to said bleed tubes to prevent entry of water through said bleed tubes when said vehicle with said nose cone thereon is submerged.

3. The nose cone in accordance with claim 1 wherein said nose cone body and cap are of a closed cell elastomeric foam.

4. The nose cone in accordance with claim 3 wherein said nose cone body is formed of a plurality of sheets of said elastomeric foam and said nose cone cap is formed of a plurality of sheets of said elastomeric foam.

5. The nose cone in accordance with claim 4 wherein said nose cone body plurality of sheets are fixed to each other by adhesive and said nose cone cap plurality of sheets are fixed to each other by adhesive.

6. The nose cone in accordance with claim 3 wherein said nose cone cap is adhesively secured to said nose cone body.

7. The nose cone in accordance with claim 3 wherein said foam is sufficiently rigid and of sufficient strength such that closed cells therein are prevented from collapse under water pressure at a selected depth of said vehicle in said water environment.

8. A method for shielding a sonar array in a nose portion of an underwater vehicle from acoustic pressures in a water environment, the method comprising the steps of:

providing a nose cone including a substantially cylindrically-shaped tubular body, a cap fixed to one end of said body, bleed tubes extending through a selected one of said body, said cap, and said body and said cap, and bleed tube caps for closing off said bleed tubes;

sliding said nose cone body onto side wall portions of said vehicle nose portion with said bleed tube caps removed from said bleed tubes, until said nose cone cap is proximate a forward-most portion of said vehicle nose portion; and closing said bleed tubes with said bleed tube caps;

whereby to ready said vehicle for underwater operation with said sonar array acoustically shielded by said nose cone.

9. The method in accordance with claim 8 and including the further step of providing a bead of sealant along a juncture of an after end of said body and a side wall portion of said vehicle.

* * * * *